US008789699B2

(12) United States Patent
Patstone et al.

(10) Patent No.: US 8,789,699 B2
(45) Date of Patent: Jul. 29, 2014

(54) CONTAINER ASSEMBLY

(75) Inventors: Christopher H. Patstone, Northampton, MA (US); Joseph C Strzegowski, Jr., Conway, MA (US); Stephen R. Smiaroski, South Deerfield, MA (US); David Jenny, Northampton, MA (US)

(73) Assignee: Hardigg Industries, Inc., South Deerfield, MA (US)

( * ) Notice: Subject to any disclaimer, the term of this patent is extended or adjusted under 35 U.S.C. 154(b) by 579 days.

(21) Appl. No.: 12/353,490

(22) Filed: Jan. 14, 2009

(65) Prior Publication Data

US 2009/0178946 A1 Jul. 16, 2009

Related U.S. Application Data

(60) Provisional application No. 61/021,195, filed on Jan. 15, 2008.

(51) Int. Cl.
*B65D 21/02* (2006.01)

(52) U.S. Cl.
USPC ..... 206/503

(58) Field of Classification Search
USPC ..... 206/503, 508, 509, 511; 220/315
See application file for complete search history.

(56) References Cited

U.S. PATENT DOCUMENTS

| | | | | | |
|---|---|---|---|---|---|
| 3,524,415 | A | * | 8/1970 | Heiman | 108/53.3 |
| 3,616,943 | A | * | 11/1971 | Brink | 206/508 |
| 4,883,251 | A | * | 11/1989 | Manas | 249/53 R |
| 5,184,836 | A | * | 2/1993 | Andrews et al. | 280/79.5 |
| 5,392,945 | A | * | 2/1995 | Syrek | 220/608 |
| 5,676,251 | A | * | 10/1997 | Credle, Jr. | 206/501 |
| 5,975,324 | A | * | 11/1999 | Schmitt | 220/6 |
| 6,478,158 | B2 | * | 11/2002 | Gaffney et al. | 206/705 |
| 7,537,119 | B2 | | 5/2009 | Becklin | |
| 2006/0254946 | A1 | | 11/2006 | Becklin | |

FOREIGN PATENT DOCUMENTS

| | | |
|---|---|---|
| EP | 1389590 A1 | 2/2004 |
| FR | 2400464 | 3/1979 |

* cited by examiner

*Primary Examiner* — Steven A. Reynolds
*Assistant Examiner* — King M Chu
(74) *Attorney, Agent, or Firm* — McCormick, Paulding & Huber LLP

(57) ABSTRACT

A container assembly for the storage and transport of goods, the assembly including a first portion having an interior with a substantially flat interior bottom surface. The assembly further includes a second portion pivotally connected to the first portion. The first portion has an outer surface that includes a first stacking pattern and the second portion has an outer surface that includes a second stacking pattern which is different from the first stacking pattern and configured to engage the first stacking pattern enabling the container assembly to be bi-directionally stacked on another of the container assemblies.

28 Claims, 5 Drawing Sheets

CONTAINER ASSEMBLY

CROSS-REFERENCE TO RELATED APPLICATION

This application claims priority to U.S. Provisional Application No. 61/021,195, filed on Jan. 15, 2008, titled "CONTAINER ASSEMBLY," which is hereby incorporated by reference in its entirety.

FIELD OF THE INVENTION

This invention relates, in general, to a container assembly, and deals more particularly with a container assembly having a unique, utilitarian pattern formed on opposing sides of the container assembly, whereby the pattern provides increased stacking and attachment-point advantages.

BACKGROUND OF THE INVENTION

Containers of various shapes, sizes and configurations have been employed to accommodate all manner of storage and transportation needs. Typically, in the case of containers primarily utilized to transport items, it is often necessary to protect these items from impact and/or environmental damage, as well as to make the container suitable for stacking and storage during transportation.

Towards this end, it has been known to define structural profiles on the surfaces of containers, in order to provide a pattern, or matrix, by which other like containers may be stacked with one another during transportation.

Moreover, the stacking patterns of known transportation containers typically utilize similar patterns on opposing sides of the container, oftentimes being mirror images of each other. In addition, known containers also typically employ patterns which are limited to being uni-directional in their stacking ability and frequently employ patterns that contain 'hard', or sharp edges.

With the forgoing problems and concerns in mind, it is the general object of the present invention to provide a container assembly with a novel stacking profile defined on opposing sides of the container. In one preferred embodiment, the profile formed on one side of the container is not the same as the inter-connecting profile defined on the opposing side of the container. Moreover, the defined profiles of the present invention enable a bi-directional stacking capability, as well as having edges of the defined profiles that are more resistant to wear and damage. A novel latch mechanism for the container assembly of the present invention is also proposed.

SUMMARY OF THE INVENTION

It is an object of the present invention to provide a container assembly.

It is another object of the present invention to provide a container assembly having stacking patterns formed on opposing sides of the container.

It is another object of the present invention that the stacking patterns of the container assembly enable the bi-directional stacking of one of the container assemblies with another of the container assemblies.

It is another object of the present invention to provide a container assembly whereby the stacking patterns on opposing sides of the container are different from one another.

It is yet another object of the present invention to provide a container assembly having stacking patterns that are more resistant to wear and damage.

It is yet another object of the present invention to provide a container assembly having stacking patterns which also provide various attachment points for securing accessories to the container.

It is yet another object of the present invention to provide a stacking pattern for a container assembly that includes integrated wheels, wherein the integrated wheels do not interfere with the bi-directional stacking ability of the container.

It is yet another object of the present invention to provide a container assembly that includes a novel latch mechanism and location.

An embodiment of the inventive container assembly for the storage and transport of goods includes a first portion having an interior with a substantially flat interior bottom surface. The assembly further includes a second portion pivotally connected to the first portion. The first portion has an outer surface that includes a first stacking pattern and the second portion has an outer surface that includes a second stacking pattern different from the first stacking portion and configured to engage the first stacking pattern enabling the container assembly to be bi-directionally stacked on another of the container assemblies.

An embodiment of the inventive locking mechanism for a container assembly includes a hinged leaf portion having a hooked end. The leaf portion is pivotally attached to a leaf bracket which is, in turn, secured to the container assembly. The locking mechanism further includes a base portion also secured to the container assembly. The base portion has a lever with an engagement end for engagement with the hooked end. The lever is pivotally secured to the base portion. The lever may be moved to bring the engagement end into engagement with the hooked end to secure the locking mechanism and, when the locking mechanism is secured, the lever and the leaf portion cover and protect the fasteners that secure the leaf portion and the base portion to the container to prevent unauthorized access to an interior of said container assembly.

These and other objectives of the present invention, and their preferred embodiments, shall become clear by consideration of the specification, claims and drawings taken as a whole.

DETAILED DESCRIPTION OF THE PREFERRED EMBODIMENT

Figure 1:
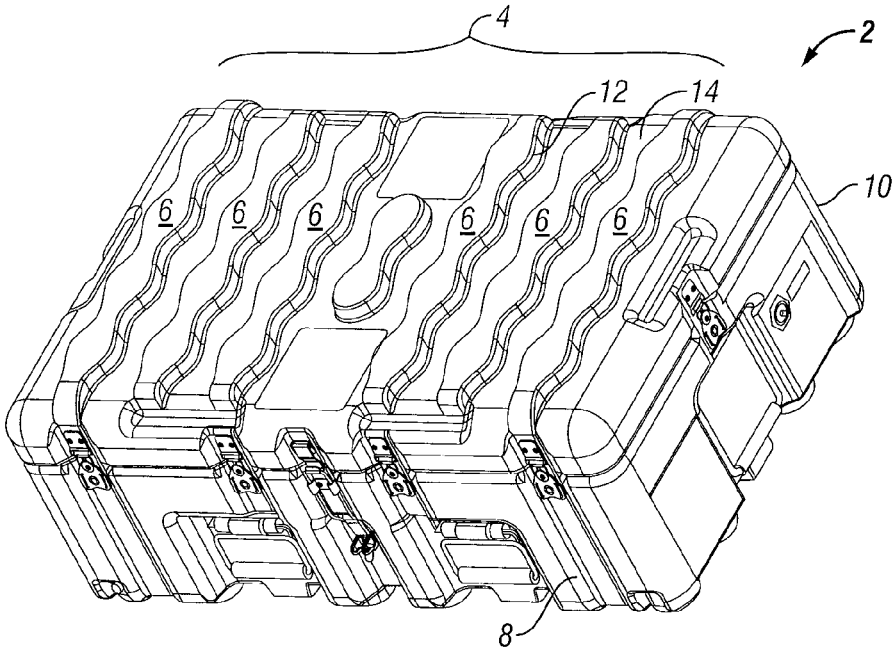
FIG. 1 is a top perspective view of an embodiment of the container assembly of the present invention.
Figure 2:
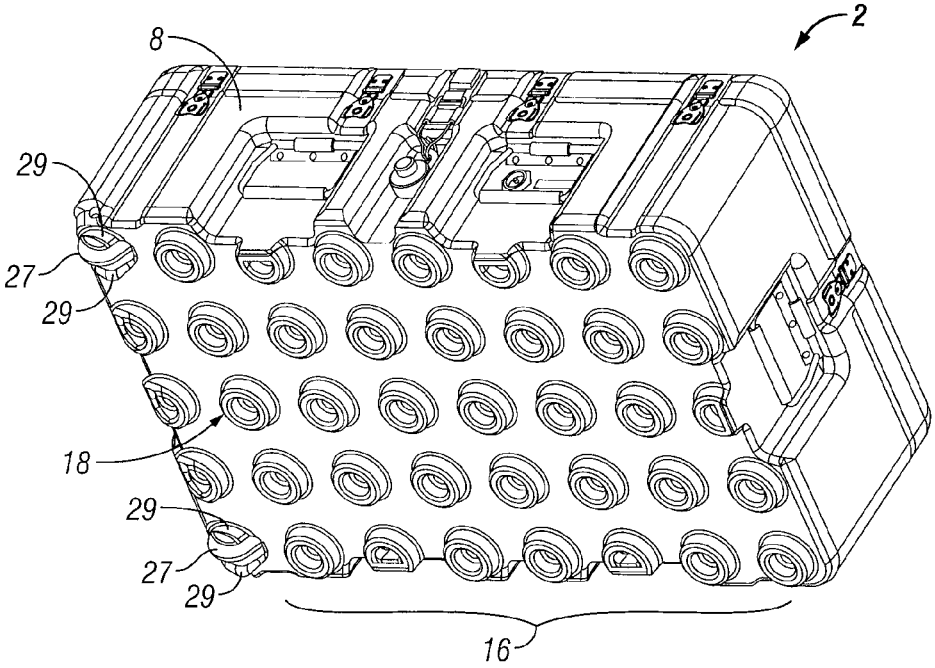
FIG. 2 is a bottom perspective view of the container assembly of FIG. 1

FIGS. 1-9E illustrate a container assembly according an embodiment of the present invention. As shown in FIGS. 1 and 2, the inventive container assembly 2 includes structural profiles formed on opposing sides of the container. In particular, one side of the container 2 defines a first stacking profile 4 that includes a series of wavy ribs or ridges 6, extending from one lateral side of the container 8, to the other 10. When located side-by-side with one another, the wavy ridges 6 define a series of wave-like profiles 12 that create laterally extending channels or valleys 14 therebetween.

As shown, the raised wavy ridges 6 undulate in a sinusoidal fashion along their lateral axis, thereby forming a series of apexes and depressions along the length of the ridges 6. The wavy ridges 6 are oriented on the container 2 such that the apexes of adjacent wavy ridges 6 are opposed to one another, thus creating a repeating series of wide and narrow, i.e., convex and concave, sections in the valleys 14.

This wave-like configuration of ridges 6 is an important aspect of the present invention. In particular, the wave like shape of the ridges 6 avoids sharp bends which act as stress concentrators. Thus, the wave shape maximizes structural strength and integrity of the ridges 6. Preferably, the wave-like shape is formed from a series of tangent arcs. As will be appreciated, the shape of the ridges 6 may also be derived from sinusoidal and quadratic equations.

Further, it is also preferable that the top surface of the ridges 6 have an area equal to the area of the valleys 14 between the ridges 6. This configuration maximizes the strength of the structure by equalizing the cross-sectional "up" and "down" areas.

Turning now to FIG. 2, an opposing side of the container 2 assembly defines a second stacking profile 16 comprising a series of generally rounded protrusions 18 which may be donut shaped as shown or, alternatively puck shaped. As will be appreciated, the protrusions 18 are dimensioned so as to fit within the wide (i.e., rounded) sections of the valleys 14 to facilitate stacking.

While the protrusions may be puck-shaped, the donut shape with its raised inner area or hole is preferable. This shape increases the flat surface area inside the container, i.e., on the container floor or bottom. The increased flat surface area creates a stable platform for goods placed within the container. The inner flat surface area also provides a convenient point to attach a fastener to, for example, secure cargo to the interior bottom floor of the container. This surface allows for the installation of fasteners without the fasteners touching the ground or interfering with corresponding stacking ridges 6.

It will therefore be readily appreciated that the profiles defined on opposing sides of the container assembly of the present invention enable the stacking of one container assembly atop another container assembly. Moreover, given the structural relationship between the protrusions 18 and the wavy valleys 14, the stacking profiles of the present invention permit the bi-directional stacking of one container assembly atop another. That is, the stacking profiles 4, 16 created on opposing sides of the container assembly are capable of stacking one such container assembly atop another, even when the two container assemblies (and, thus, their stacking patterns) are oriented at 90° from one another, i.e., bi-directional stacking. Further, the profiles allow cases to be stacked regardless of their footprint so that smaller cases can be stacked on larger cases and vice versa.

It is another aspect of the present invention that both of the stacking patterns defined on the container assembly are formed with rounded edges. By doing so, the present invention facilitates an easier integration between the donut-like protrusions 18 of one container assembly with the wide sections of the wavy valleys 14 of another container assembly. Moreover, the rounded edges of the stacking profiles make them less susceptible to damage caused by drop-impact, or the like.

It is yet another important aspect of the present invention that the side edges 12 of the wavy ridges 14 of the container assembly are formed to exhibit a 5° draft. In this manner, various accessories may be more easily and more securely attached to locations between adjacent wavy ridges (i.e., locations at least partially attached within the wavy valleys 14).

Figure 3:
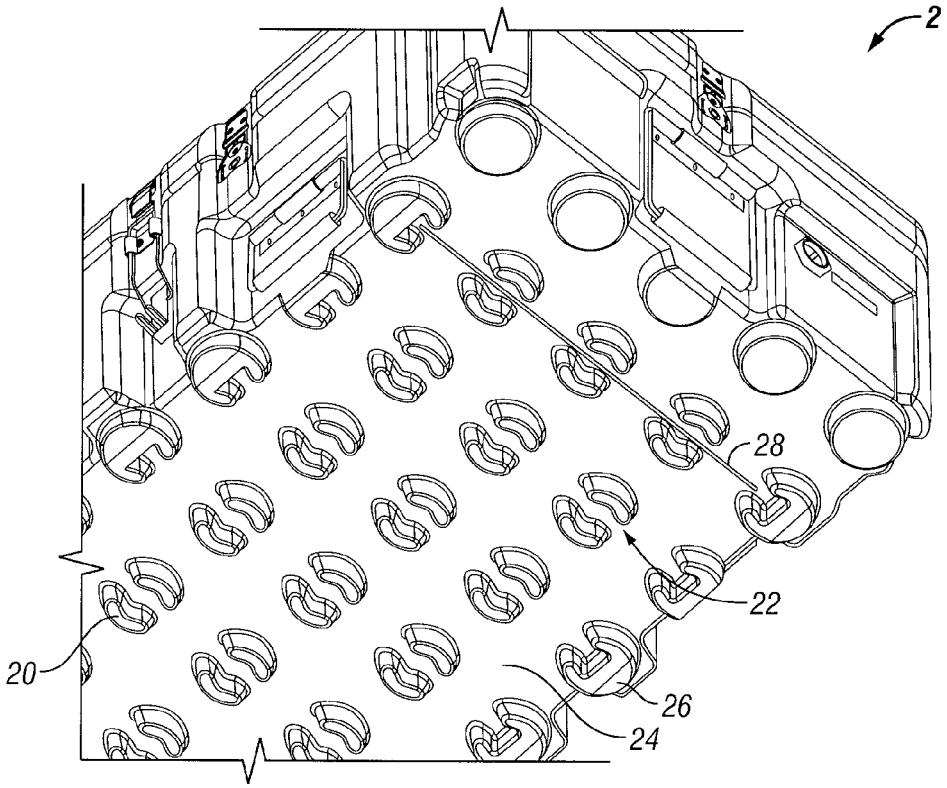
FIG. 3 is a bottom perspective view of an alternative embodiment of the container assembly of the present invention.
Figure 4:
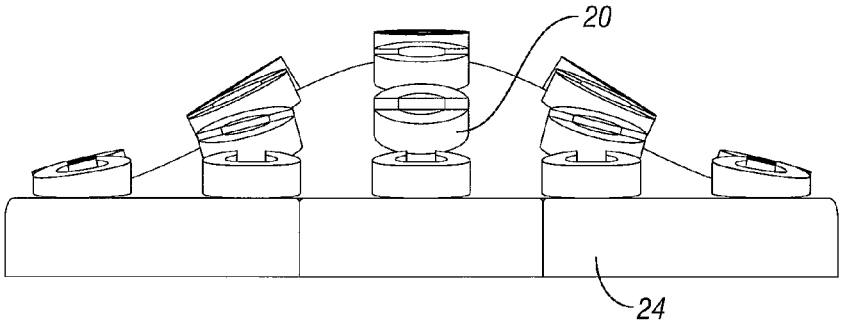
FIG. 4 is a side view of the embodiment of FIG. 3
Figure 5:
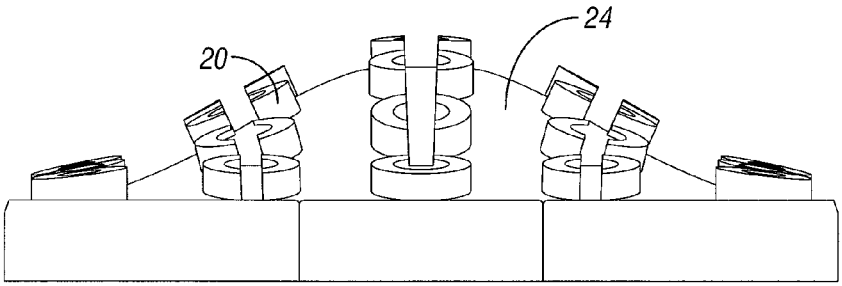
FIG. 5 is a side view of an alternative to the embodiment of FIG. 4
Figure 6:
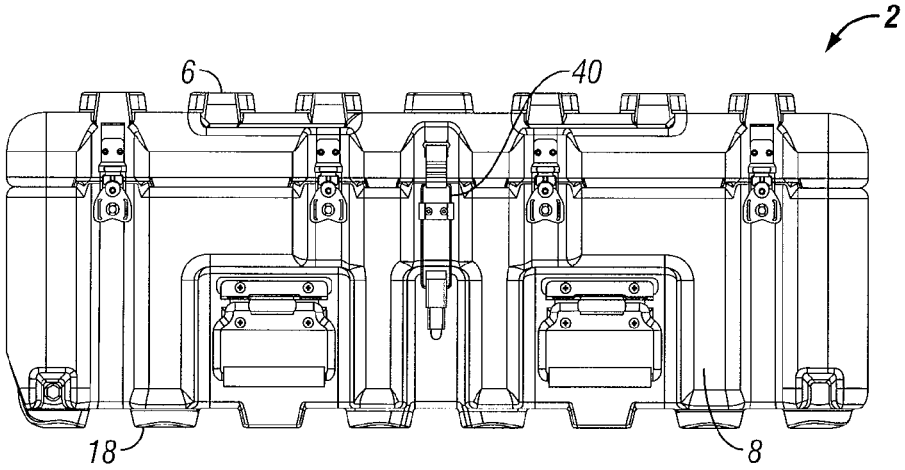
FIG. 6 is a front view of the container assembly according to the embodiments of FIGS. 1 and 3.
Figure 7:
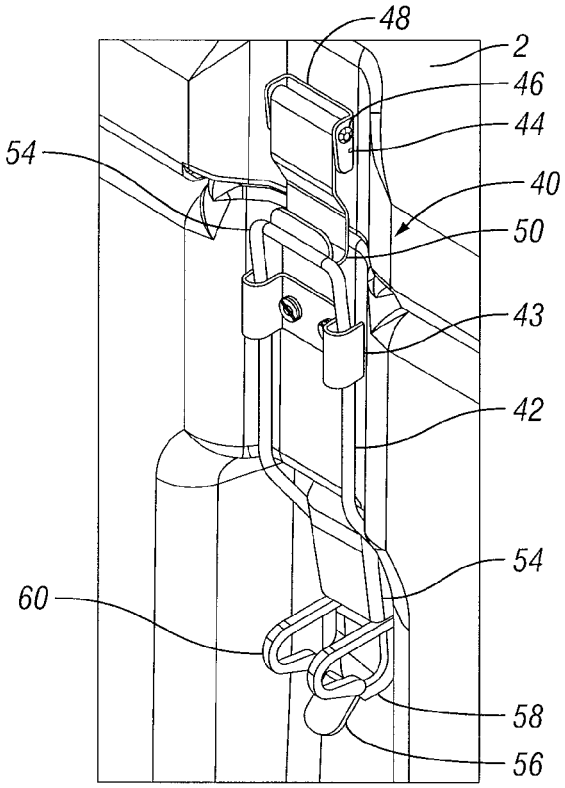
FIG. 7 is a enlarged, perspective view of a latch assembly for use with the container assembly of FIGS. 1 or 3.

Turning now to FIG. 3, the donut-like protrusions may be cut or segmented. These segmented protrusions 20 are segmented by a cut 22 which prevents water entrapment when the case assembly 2 is inverted, further increases the flat surface area inside the container 2, and reduces the entrapment of dirt and debris, facilitating easy removal of the same. While the cuts in the donuts can be in various orientations, it is preferable that they be perpendicular to the length of the container 2. This configuration results in a more rigid container wall 24 than through parallel cuts. Empirical evidence depicting this is presented in FIGS. 4 and 5.

Referring back to FIG. 3, the inventive container 2 may also feature partially cut or segmented perimeter protrusions 26. These partial cuts create C-shaped perimeteral protrusions, which, along with the fully cut protrusions 22 creates a channel having a centerline 28. As will be appreciated, the channels allow for the attachment of various objects having a member configured to engage the channels.

The inventive container 2 may also include casters 27. These are depicted in FIG. 2 and, as will be readily appreciated, allow the container 2 to be rolled during transport. Preferably, the casters 27 are located within a puck or donut 18 such that sides 29 of the donut 18 protect the casters 27.

Turning now to FIGS. 6-9E, a novel latch/locking mechanism 40 is also shown. As most clearly shown in FIGS. 1 and 2, the locking mechanism 40 is centrally located with respect to the housing of the container assembly 2, and provides increased effectiveness, security and ease of manipulation.

More specifically, the locking mechanism 40 includes a fixed base 42, a guide 43 and a hinged leaf 44. As shown, the hinged leaf 44 is free to pivot about a pin 46 that is secured within a bracket 48. The bracket 48 is secured to the container 2 through the use of conventional fasteners (not shown). The hinged leaf 44 includes a free distal end terminating in a hooked portion 50 shaped to receive a portion of the fixed base 42 when the mechanism 40 is secured.

Figure 8A:
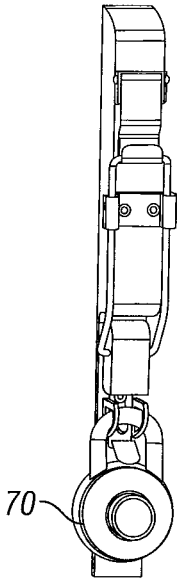
FIG. 8A-8E are front, perspective views of the latch assembly of FIG. 7 graphically illustrating operation of the latch assembly.
Figure 8B:
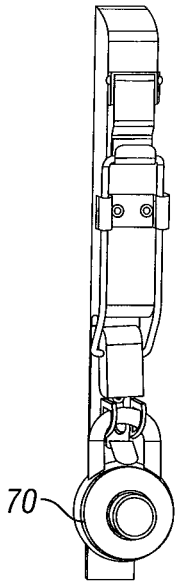
Figure 8C:
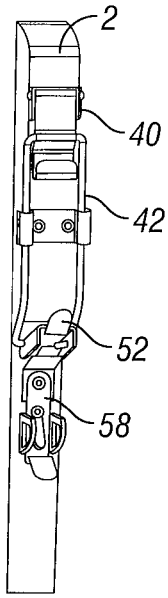
Figure 8D:
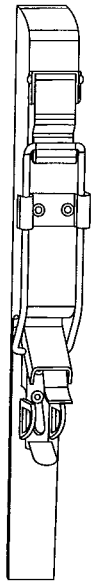
Figure 8E:
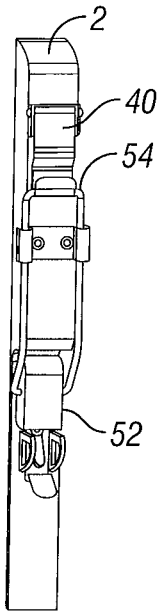

The configuration of hinged leaf 44 within the bracket 48 is an important aspect of the inventive locking mechanism. In particular, when the hooked portion 50 is engaged by the base 42, the hinged leaf 44 completely covers the fasteners used to secured the bracket 48 to the container 2. This prevents removal of the fasteners to bypass the lock and gain access to the interior of the container 2. Referring now to FIGS. 8C and 8E, the base 42 is similarly secured to the container 2. Here, a lever 52 of the base 42 covers the fasteners when the lock is secured to prevent access to the case interior.

The base 42 includes a lever 52, which pivots up and down about a base bracket 58 to raise or lower a u-shaped engagement surface 54. The u-shaped engagement surface 54 is configured to engage and pull down on the hooked portion 50 of the hinged leaf 44 to secure a top or lid of a container 2 to a base portion. The lever 52 terminates with a tab 56 that is used to raise or lower the lever 52. The path and movement of the engagement surface 54 are defined and limited by the guide 43.

Figure 9A:
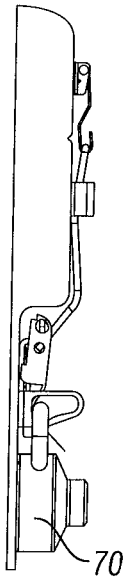
FIG. 9A-9E are front, perspective view of the latch assembly of FIG. 7 graphically illustrating operation of the latch assembly.
Figure 9B:
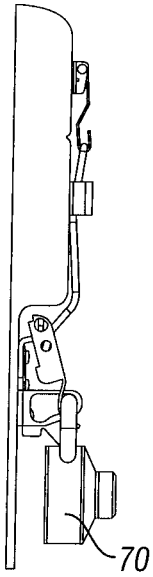
Figure 9C:
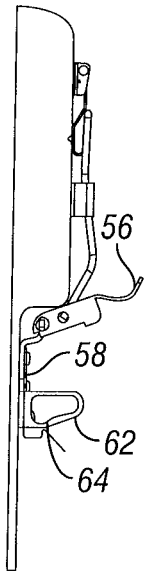
Figure 9D:
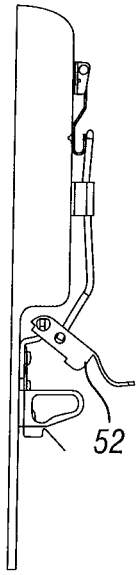

Moreover, the base bracket 58 includes padlock eyes 60 which, as will be appreciated, receives a u-shaped shackle of a padlock 70 (FIGS. 7, 8A, 8B, 9A, 9B). Significantly, the eyes 60 are shaped such that they include a sloped or angled shackle surface 62, which includes a shackle divot 64 sized to accommodate the lock shackle (FIG. 9C). This surface 62 and divot 64 are important in that they cause a padlock to slide down via gravity toward the container and into the divot 64. This allows the padlock to be complete recessed within a valley or channel of the outer case surface during shipping. This, in turn, minimizes potential damage to the container, the lock mechanism, the lock, and any adjacent cargo.

Figure 9E:
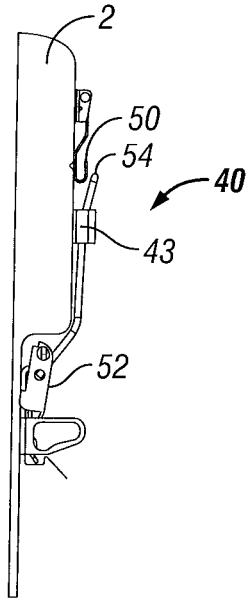

In use, and as shown in FIGS. 8A-8E and 9A-9E, the locking mechanism 40 is unlocked by first unlocking and removing the padlock. The tab 56 and lever 52 are then pulled upward and outward so that the engagement surface 54 disengages with the hooked portion 50 of the hinged leaf 44 allowing the container 2 to be opened. As shown in FIG. 9E, then the container 2 is unlocked the lid may be closed without the risk of self-locking. That is, the engagement portion 54 is not in a position to engage the hooked portion 50. This is an important safety and operational benefit of the inventive locking mechanism.

While the invention has been described with reference to the preferred embodiments, it will be understood by those skilled in the art that various obvious changes may be made, and equivalents may be substituted for elements thereof, without departing from the essential scope of the present invention. Therefore, it is intended that the invention not be limited to the particular embodiments disclosed, but that the invention includes all embodiments falling within the scope of the appended claims.

What is claimed is:

1. A container assembly for the storage and transport of goods, said assembly comprising:

a first portion having an interior;

a second portion pivotally connected to said first portion; and wherein said first portion has an outer surface that includes a first stacking pattern formed thereon, said first stacking pattern being defined by a plurality of first stacking elements, said first stacking elements each having first lateral sidewalls defining a first peripheral shape of said first stacking elements;

wherein said second portion has an outer surface that includes a second stacking pattern formed thereon, said second stacking pattern being defined by a plurality of second stacking elements, said second stacking elements each having second lateral sidewalls defining a second peripheral shape of said second stacking elements;

wherein said first peripheral shape of at least one of said first stacking elements is different from said second peripheral shape of at least one of said second stacking elements;

wherein said second stacking pattern is configured to engage said first stacking pattern enabling said container assembly to be bi-directionally stacked on another of said container assemblies; and wherein said second stacking elements are configured to directly contact said first stacking elements to prevent lateral movement of said container assembly with respect to said another of said container assemblies.

2. The container assembly of claim 1, wherein said second stacking pattern is a plurality of spaced-apart ribs.

3. The container assembly of claim 2, wherein said spaced-apart ribs have a wave shape.

4. The container assembly of claim 2, wherein said spaced-apart ribs have a side edge portion having a draft angle of approximately 5°.

5. A container assembly for the storage and transport of goods, said assembly comprising:

a first portion having an interior;

a second portion pivotally connected to said first portion; and wherein said first portion has an outer surface that includes a first stacking pattern formed thereon, said first stacking pattern being defined by a plurality of first stacking elements, said first stacking elements each having first lateral sidewalls defining a first peripheral shape of said first stacking elements;

wherein said second portion has an outer surface that includes a second stacking pattern formed thereon, said second stacking pattern being defined by a plurality of second stacking elements, said second stacking elements each having second lateral sidewalls defining a second peripheral shape of said second stacking elements;

wherein said first peripheral shape of at least one of said first stacking elements is different from said second peripheral shape of at least one of said second stacking elements;

wherein said second stacking pattern is configured to engage said first stacking pattern enabling said container assembly to be bi-directionally stacked on another of said container assemblies;

wherein said second stacking pattern is a plurality of spaced-apart ribs;

wherein said spaced-apart ribs have a wave shape; and wherein said outer surface of said second portion is defined by front, back and side edges and said spaced-apart, wave shaped ribs extend from said front edge to said back edge of said outer surface.

6. A container assembly for the storage and transport of goods, said assembly comprising:

a first portion having an interior;

a second portion pivotally connected to said first portion; and wherein said first portion has an outer surface that includes a first stacking pattern formed thereon, said first stacking pattern being defined by a plurality of first stacking elements, said first stacking elements each having first lateral sidewalls defining a first peripheral shape of said first stacking elements;

wherein said second portion has an outer surface that includes a second stacking pattern formed thereon, said second stacking pattern being defined by a plurality of second stacking elements, said second stacking elements each having second lateral sidewalls defining a second peripheral shape of said second stacking elements;

wherein said first peripheral shape of at least one of said first stacking elements is different from said second peripheral shape of at least one of said second stacking elements;

wherein said second stacking pattern is configured to engage said first stacking pattern enabling said container assembly to be bi-directionally stacked on another of said container assemblies;

wherein said second stacking pattern is a plurality of spaced-apart ribs;

wherein said spaced-apart ribs have a wave shape; and wherein said spaced-apart, wave shaped ribs are parallel to one another on said outer surface of said second portion and include convex and concave portions that are in alignment with said convex and concave portions of adjacent ribs creating a channel therebetween, said channel having convex and concave sections.

7. The container assembly of claim 6, wherein said second stacking elements are protrusions that fit within said concave channel sections to secure a container assembly to another of said container assemblies.

8. The container assembly of claim 6, wherein said ribs have an area that is substantially equal to an area of said channel maximizing a strength of said first portion.

9. The container assembly of claim 1, wherein said first stacking pattern includes at least one protrusion, said protrusion being puck shaped.

10. The container assembly of claim 1, wherein said first stacking pattern includes at least one protrusion, said protrusion being substantially annular in shape.

11. A container assembly for the storage and transport of goods, said assembly comprising:

a first portion having an interior;

a second portion pivotally connected to said first portion; and wherein said first portion has an outer surface that includes a first stacking pattern formed thereon, said first stacking pattern being defined by a plurality of first stacking elements, said first stacking elements each having first lateral sidewalls defining a first peripheral shape of said first stacking elements;

wherein said second portion has an outer surface that includes a second stacking pattern formed thereon, said second stacking pattern being defined by a plurality of second stacking elements, said second stacking elements each having second lateral sidewalls defining a second peripheral shape of said second stacking elements;

wherein said first peripheral shape of at least one of said first stacking elements is different from said second peripheral shape of at least one of said second stacking elements;

wherein said second stacking pattern is configured to engage said first stacking pattern enabling said container assembly to be bi-directionally stacked on another of said container assemblies wherein said first stacking pattern includes at least one protrusion, said protrusion being substantially annular in shape; and wherein said annular protrusion has an inner surface that extends inward and forms a portion of an interior bottom surface of said first portion.

12. A container assembly for the storage and transport of goods, said assembly comprising:

a first portion having an interior;

a second portion pivotally connected to said first portion; and wherein said first portion has an outer surface that includes a first stacking pattern formed thereon, said first stacking pattern being defined by a plurality of first stacking elements, said first stacking elements each having first lateral sidewalls defining a first peripheral shape of said first stacking elements;

wherein said second portion has an outer surface that includes a second stacking pattern formed thereon, said second stacking pattern being defined by a plurality of second stacking elements, said second stacking elements each having second lateral sidewalls defining a second peripheral shape of said second stacking elements;

wherein said first peripheral shape of at least one of said first stacking elements is different from said second peripheral shape of at least one of said second stacking elements;

wherein said second stacking pattern is configured to engage said first stacking pattern enabling said container assembly to be bi-directionally stacked on another of said container assemblies wherein said first stacking pattern includes at least one protrusion, said protrusion being substantially annular in shape; and wherein said annular protrusion is comprised of two c-shaped arcs, said arcs facing one another and having a channel therebetween, said channel facilitating cleaning of dirt and debris from said protrusion.

13. The container assembly of claim 10, wherein said at least one protrusion is a plurality of substantially annular protrusions at least one of which includes a caster.

14. The container assembly of claim 12, wherein said at least one annular protrusion is a plurality of substantially annular protrusions, said protrusions being arranged in an array so that said channels between said c-shaped arcs of said individual protrusions are in alignment forming a elongated channel configured for attachment of an object.

15. A case for the storage and transport of goods, said case comprising:

a base having an interior with a substantially flat interior bottom surface;

a lid pivotally connected to said base, said lid having an outer surface that includes a plurality of spaced-apart, wave shaped ribs that are parallel to one another on said outer surface of said lid, said wave shaped ribs being defined by lateral sidewalls that extend continuously from one edge of said lid to an opposing edge of said lid, said wave shaped ribs including convex and concave portions that are in alignment with said convex and concave portions of adjacent ribs creating a channel therebetween, said convex and concave portions of said lateral sidewalls defining a peripheral shape of said channel; and wherein said base has an outer surface that includes a plurality of substantially annular protrusions having annular side walls defining a peripheral shape of said annular protrusions and configured to fit within said concave channel sections so that said case may be bi-directionally secured to another of said case; and wherein said peripheral shape of said channel is different than said peripheral shape of said annular protrusions.

16. The case of claim 15, wherein said ribs have an area that is substantially equal to an area of said channel maximizing a strength of said lid.

17. The case of claim 15, wherein said annular protrusion has an inner surface that extends inward and forms a portion of said substantially flat interior bottom surface of said base.

18. The case of claim 15, wherein said annular protrusions are comprised of two c-shaped arcs, said arcs facing one another and having a channel therebetween, said channel facilitating cleaning of dirt and debris from said protrusions.

19. The case of claim 15, wherein at least one of said protrusions includes a caster.

20. The case of claim 15, wherein said, said protrusions are arranged in at least one array so that said channels between said c-shaped arcs of said individual protrusions are in alignment forming a elongated channel configured for attachment of an object.

21. A container assembly for the storage and transport of goods, said assembly comprising:

a first portion having an interior and an outer surface that includes a first stacking pattern formed thereon, said first stacking pattern being defined by a plurality of first stacking elements;

a second portion connected to said first portion and having an outer surface that includes a second stacking pattern formed thereon, said second stacking pattern being defined by a plurality of second stacking elements;

wherein at least one of said plurality of second stacking elements has a geometric configuration that is different than another of said plurality of second stacking elements;

wherein said second stacking pattern is configured to selectively engage said first stacking pattern enabling said container assembly to be bi-directionally stacked on another of said container assemblies; and wherein said second stacking elements are configured to directly contact said first stacking elements to prevent lateral movement of said container assembly with respect to said another of said container assemblies.

22. The container assembly of claim 21, wherein:

each of said plurality of first stacking elements have the same geometric configuration.

23. The container assembly of claim 21, wherein said geometric configuration of said at least one of said plurality of second stacking elements is different than at least one of said plurality of first stacking elements.

24. The container assembly of claim 21, wherein said plurality of second stacking elements includes more stacking elements than said plurality of first stacking elements.

25. The container assembly of claim 21, wherein an area of at least one of said plurality of second stacking elements is smaller than an area of another of said plurality of second stacking elements.

26. The container assembly of claim 21, wherein said geometric configuration of said at least one of said plurality of second stacking elements comprises a shape of said at least one of said plurality of second stacking elements.

27. The container assembly of claim 21, wherein side edges of at least one of said second stacking elements are formed to exhibit a 5° draft.

28. The container assembly of claim 21, wherein side edges of at least one of said second stacking elements are formed to exhibit a draft having an angle greater than zero.

* * * * *